US006175996B1

(12) United States Patent
Gstrein et al.

(10) Patent No.: US 6,175,996 B1
(45) Date of Patent: Jan. 23, 2001

(54) METHOD OF FORMING A PAPERMAKERS' FELT

(75) Inventors: Hippolit Gstrein, Gloggnitz (AT); Thomas G. Gulya, Raleigh, NC (US)

(73) Assignee: Weavexx Corporation, Wake Forest, NC (US)

( * ) Notice: Under 35 U.S.C. 154(b), the term of this patent shall be extended for 0 days.

(21) Appl. No.: 09/359,213

(22) Filed: Jul. 22, 1999

(51) Int. Cl.[7] ..... D04H 18/00; B32B 31/16
(52) U.S. Cl. ..... 28/114; 28/111
(58) Field of Search ..... 28/107, 111, 113, 28/114, 110, 115, 109

(56) References Cited

U.S. PATENT DOCUMENTS

| | | | | |
|---|---|---|---|---|
| 2,845,687 | * | 8/1958 | Howard | 28/114 |
| 4,283,454 | * | 8/1981 | Buchanan | 28/107 |
| 4,357,386 | * | 11/1982 | Luciano et al. | 28/107 |
| 4,701,986 | * | 10/1987 | Gunther et al. | 28/114 |
| 4,856,192 | * | 8/1989 | Kis | 28/114 |
| 4,878,278 | * | 11/1989 | Hsu et al. | 28/114 |
| 5,143,771 | * | 9/1992 | Fourezon | 28/111 |
| 5,732,453 | * | 3/1998 | Dilo et al. | 28/114 |
| 5,732,543 | | 3/1998 | Dilo | 28/114 |
| 5,894,643 | * | 4/1999 | Fehrer | 28/107 |
| 6,000,112 | * | 12/1999 | Ollinger et al. | 28/114 |
| 6,029,327 | * | 2/2000 | Sheehan et al. | 28/114 |

FOREIGN PATENT DOCUMENTS

| | | | |
|---|---|---|---|
| 19640750A1 | 4/1997 | (DE) | D04H/1/46 |
| 0892102A2 | 1/1999 | (EP) | D04H/18/00 |

* cited by examiner

*Primary Examiner*—Amy B. Vanatta
(74) *Attorney, Agent, or Firm*—Myers Bigel Sibley & Sajovec

(57) ABSTRACT

A method of forming a papermakers' felt first comprises providing a needle loom having a needle board, a plurality of needles mounted on the needle board, and a needle motion unit. The needle motion unit moves the needle board such that the needles mounted thereon travel on a predetermined path that includes upward and downward segments, wherein each of the upward and downward segments includes both forward and rearward motion. The method then comprises the step of continuously conveying a base fabric and a batt web overlying the base fabric in a first direction past the needle board. The base fabric includes a first set of machine direction yarns and a first set of cross machine direction yarns interwoven with the first set of machine direction yarns in a predetermine repeating pattern, and the batt web comprises batt fibers. The next step of the method is inserting batt fibers from the batt web into the base fabric with the plurality of needles as the base fabric is conveyed past the needle board and as the needle board travels along the predetermined path to form a batt layer attached to and overlying the base fabric. This method can reduce or eliminate negative effects on press felts resulting from needling.

29 Claims, 7 Drawing Sheets

METHOD OF FORMING A PAPERMAKERS' FELT

FIELD OF THE INVENTION

The present invention relates generally to papermakers' fabrics and more specifically to methods of manufacturing papermakers' felts.

BACKGROUND OF THE INVENTION

In the conventional fourdrinier papermaking process, a water slurry, or suspension, of cellulosic fibers (known as the paper "stock") is fed onto the top of the upper run of an endless belt of woven wire and/or synthetic material that travels between two or more rollers. The belt, often referred to as a "forming fabric," provides a papermaking surface on the upper surface of its upper run which operates as a filter to separate the cellulosic fibers of the paper stock from the aqueous medium, thereby forming a wet paper web. The aqueous medium drains through mesh openings of the forming fabric, known as drainage holes, by gravity alone or with assistance from one or more suction boxes located on the lower surface (i.e., the "machine side") of the upper run of the fabric.

After leaving the forming section, the paper web is transferred to a press section of the paper machine, in which it is passed through the nips of one or more pairs of pressure rollers covered with another fabric, typically referred to as a "press felt." Pressure from the rollers removes additional moisture from the web; the moisture removal is often enhanced by the presence of a "batt" layer on the press felt. The paper is then conveyed to a drier section for further moisture removal. After drying, the paper is ready for secondary processing and packaging.

Press felts typically include two components: a base fabric and one or more batt layers. The base fabric is typically a woven construction that includes cabled or single monofilaments, plied multifilaments, or spun yarns. In a press felt, the base fabric may be a single layer fabric, an interwoven multilayer fabric, or a laminated construction comprising two or more distinct and separate fabric layers. The weave pattern(s) and yarn sizes and configurations employed in the base fabric are selected for the desired performance of the fabric; in particular, the fabric is designed for a desired balance of properties that include pressure uniformity, flow resistance, void volume, and compressibility.

The batt layer(s) of a fabric typically comprise staple fibers (usually synthetic fibers, such as nylon or polyester) that are applied in overlying layers to the base fabric. The thickness, denier and material of the batt fibers are typically selected for their contribution to the desired performance properties of the overall press felt.

In the typical manufacture of a press felt, batt fibers are "carded" to form a uniform web, then needled from this web into the base fabric. In the needling process, the batt web and base fabric are fed into a needle loom, where many needles (often on the order of 1,000–4,000 needles per lineal meter) are employed to insert the batt fibers into the base fabric. Conventionally, the needles are mounted in an industry standard "random" pattern on a needle board. The needle board is mounted on a needle beam, which in turn is mounted on the loom so that it can move in a reciprocating path in a direction normal to the batt web and fabric. Most commonly, the needles are of a "reverse-barb" configuration which snags batt fibers when moving in a direction toward the batt web and base fabric (ie., during insertion segment of the needle stroke) but fails to snag fibers when moving away from the batt and fabric (i.e., during the retraction segment of the needle stroke). Thus, as the needles are inserted through the batt and into the base fabric, the barbs of the needles engage the fibers of the batt web and thread them into the interstices of the base fabric. The needles can be retracted from the base fabric and batt web without the barbs snagging the batt fibers.

Generally, a press felt undergoes multiple passes through a needling loom, some of which may be conducted with different needle penetration depths, needle configurations, and fabric advance rates, and some of which simply involve the insertion of the needles into the base fabric without the addition of more batt fibers (when no additional batt fiber is applied, the needling typically serves to further engage batt fiber already present on the base fabric and reduce the thickness of the batt layer). Once needling is complete, the press felt is usually then subjected to some post-needling steps, such as heat setting, washing and singeing.

As noted above, during the needling process the needle board upon which the needles are mounted reciprocates along a path normal to the batt and fabric. The fabric and batt are advanced between needle strokes, either continuously (which is preferred for manufacturing efficiency) or intermittently, into position for subsequent needling.

Although continuous advancing of the batt and fabric is preferred for increased needling rate, this process can be deleterious for the finished press felt product, and in particular for the base fabric. The continuous motion of the base fabric can cause portions of the base fabric (especially the yarns of the base fabric that extend in a direction normal to the direction the fabric is moving) to contact and exert bending forces on the inserted needle. This interaction with the needle causes the yarns of the fabric to alternately stretch and compress in localized regions around each needle. Not only are the yarns of the base fabric stretched and compressed, the batt overlying these regions can become bunched or thinned. These heterogeneous regions of the press felt can adversely affect the smoothness and uniformity of the paper processed with the press felt. Also, the barbs of the needles can rub against the yarns of the fabric and have a "sawing" effect that may cut or weaken the yam. All of these effects can negatively impact the performance and consistency of the press felt during operation.

SUMMARY OF THE INVENTION

These and other objects are satisfied by the present invention, which is directed to a method of forming a papermakers' felt that reduces the risk of damaging the base fabric and batt thereof. The method first comprises providing a needle loom having a needle board, a plurality of needles mounted on the needle board, and a needle motion unit. The needle motion unit moves the needle board such that the needles mounted thereon travel on a predetermined path that includes upward and downward segments, wherein each of the upward and downward segments includes both forward and rearward motion. The method then comprises the step of continuously conveying a base fabric and a batt web overlying the base fabric in a first direction past the needle board. The base fabric includes a first set of machine direction yarns and a first set of cross machine direction yarns interwoven with the first set of machine direction yarns in a predetermined repeating pattern, and the batt web comprises batt fibers. The next step of the method is inserting batt fibers from the batt web into the base fabric with the plurality of needles as the base fabric is conveyed past the needle board and as the needle board travels along the predetermined path to form a batt layer attached to and overlying the base fabric. This method can reduce or eliminate the negative effects on press felts discussed hereinabove.

The method is particularly well-suited for press felts in which the base fabric includes fine yarns. In one preferred embodiment, the base fabric includes cabled, plied machine and cross machine direction yarns formed of individual monofilaments having a diameter of between about 0.1 and 0.3 mm.

The method can also be practiced by determining the positions of the yarns within the base fabric, performing the step of inserting the yarns as described above responsive to the positions of the yarns, then performing a second inserting step responsive to the positions of the yarns. Because the method has the effect of reducing the degree to which yarns are displaced during needling, more precise and accurate needling is possible.

The method of the present invention can also be practiced by inserting batt fiber at an oblique angle to the base fabric. This may be carried out by passing the base fabric and batt web over a needle bed that is obliquely disposed relative to the general direction of needle travel. Under this method, the batt fibers of the batt layer can become anchored more firmly within the base fabric than in prior art press felts thereby improving the performance and durability of the press felt.

DETAILED DESCRIPTION OF THE INVENTION

The present invention now will be described more fully hereinafter with reference to the accompanying drawings, in which preferred embodiments of the invention are shown and described. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like components throughout. Components and layers may be exaggerated for clarity.

As used herein, the terms "machine direction" (MD) and "cross machine direction" (CMD) refer, respectively, to a direction aligned with the direction of travel of the papermakers' fabric on a papermaking machine, and a direction parallel to the fabric surface and transverse to the direction of travel. Also, both flat weaving and endless weaving methods are well known in the art for the production of a base fabric for a papermakers' felt, and the term "endless belt" as used herein refers to fabrics and press felts made by either method.

Figure 1:
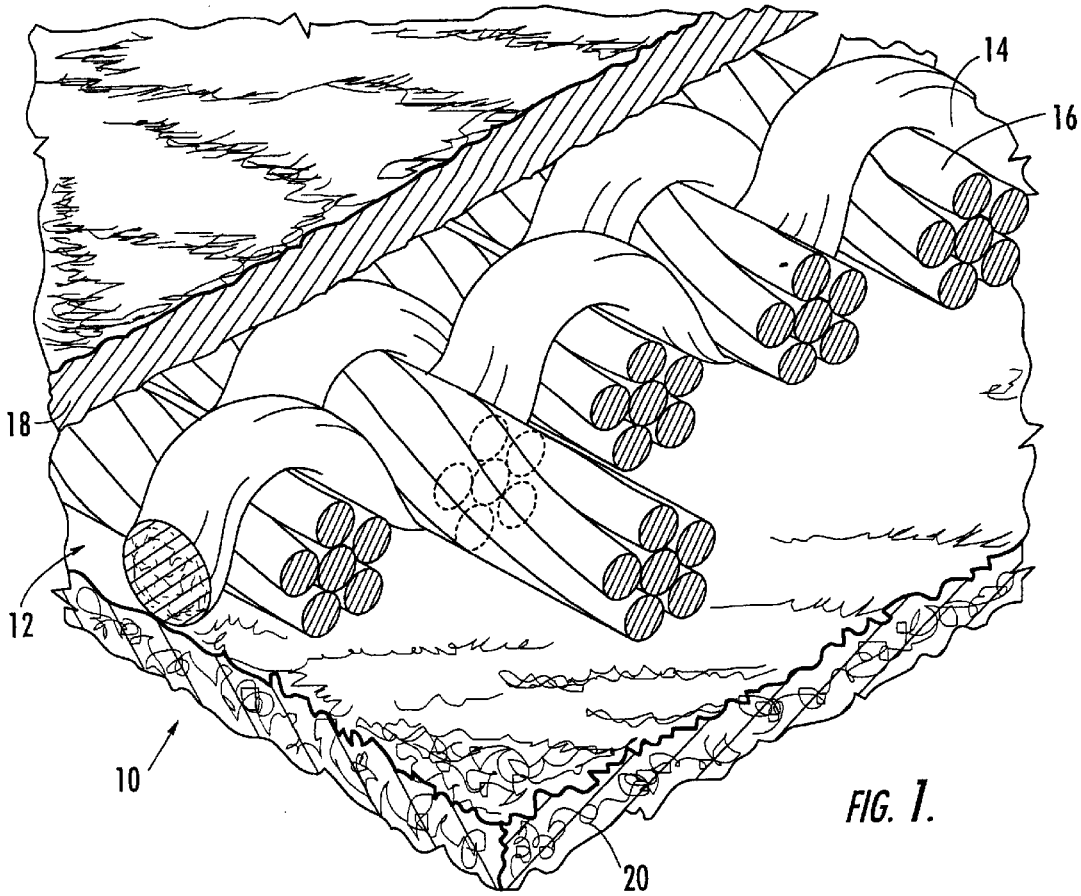
FIG. 1 is a section view of a press felt formed with the method of the present invention.

Referring now to the drawings, FIG. 1 illustrates an enlarged section of a press felt 10; the entirety of the press felt 10, which is in an endless belt configuration, follows the pattern illustrated in FIG. 1 and need not be illustrated herein for those skilled in this art to understand its configuration.

As can be seen in FIG. 1, the illustrated press felt 10 includes a single layer plain weave base fabric 12 which comprises CMD yarns 14 and MD yarns 16. Those skilled in this art will recognize that other fabric constructions can be employed as the base fabric 12, including other single layer fabrics, duplex fabrics and triplex fabrics (these terms will be understood by those skilled in this art and need not be described in detail herein). Also, the base fabric 12 can comprise a so-called "laminated" or "stratified" structure that includes separate layers of fabrics. Virtually any weave pattern known to those skilled in this art, such as plain weaves, twills, satins, and the like, can be used for the base fabric 12.

Figure 8:
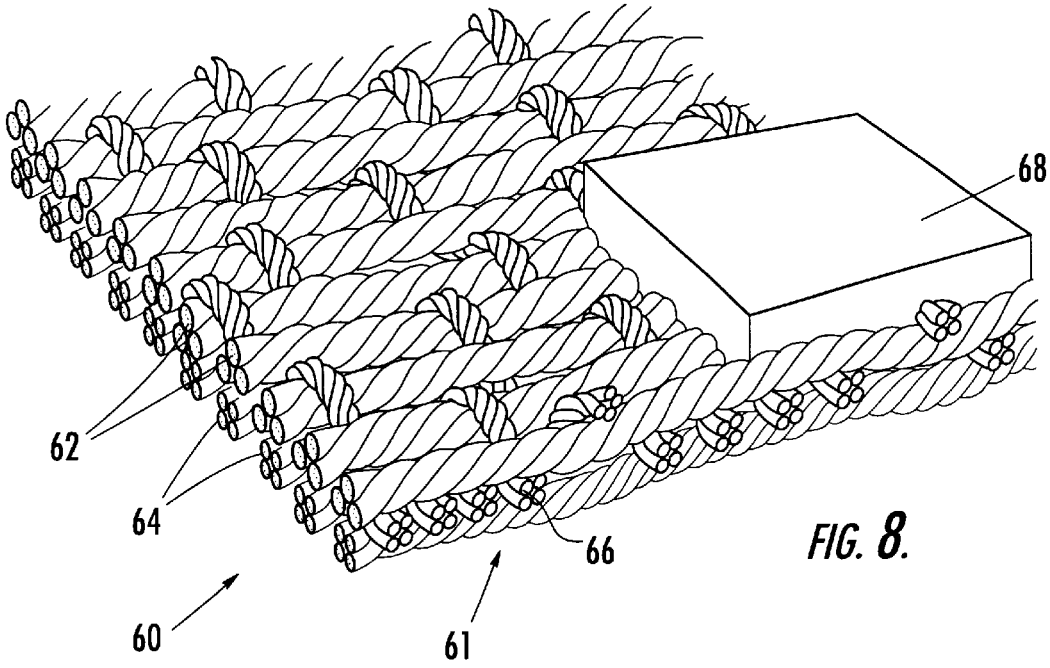
FIG. 8 is a partial cutaway perspective view of an alternative press felt having a duplex base fabric upon which the method of the present invention can be practiced.
Figure 9:
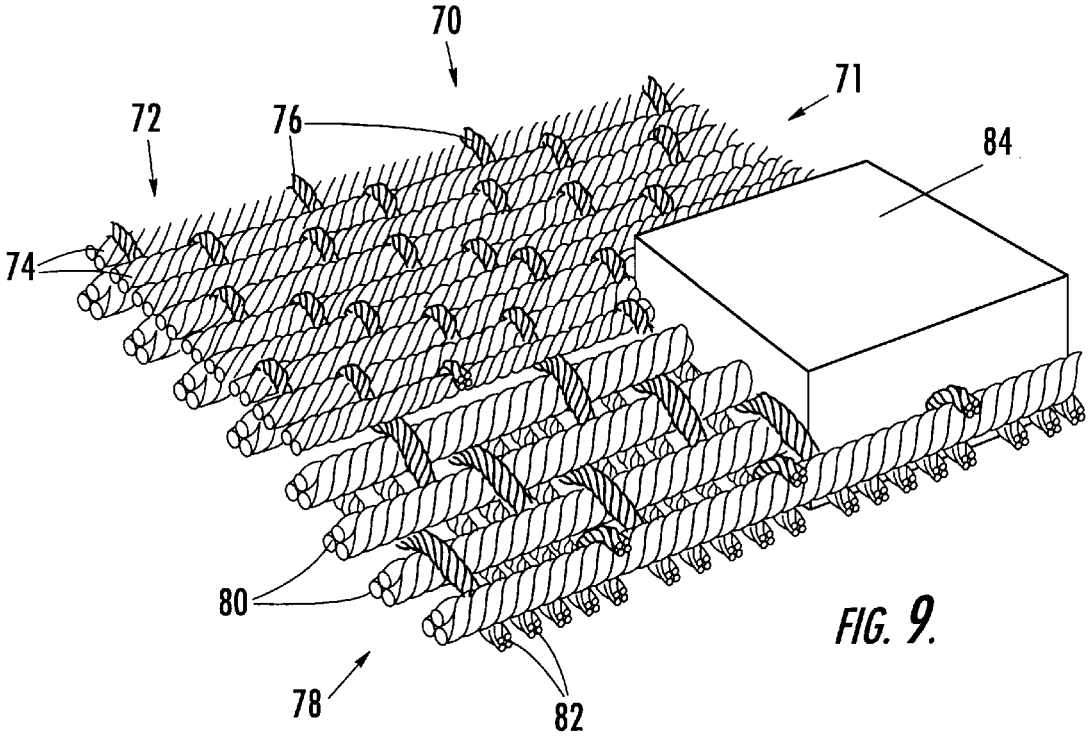
FIG. 9 is a partial cutaway perspective view of an alternative press felt having a laminated base fabric upon which the method of the present invention can be practiced.

Two other exemplary base fabric constructions are illustrated in FIGS. 8 and 9. In FIG. 8, a press felt 60 includes a woven duplex base fabric 61 that comprises upper and lower sets of machine direction yarns 62, 64 interwoven with cross machine direction yarns 66. These are interwoven in a conventional 6 harness weave pattern in which each CMD yarn 66 passes over one upper MD 62 yarn and under one lower MD yarn 66 for each consecutive set of six upper and lower MD yarns 62, 64. The base fabric 61 is covered by a batt layer 68. In FIG. 9, a press felt 70 includes a laminated duplex base fabric 71 that comprises an upper layer 72 formed of interwoven MD yarns 74 and CMD yarns 76 and a lower layer 78 formed of interwoven MD yarns 80 and CMD yarns 82. Each of the upper and lower layers 72, 78 follow a weave pattern in which the CMD yarns 76, 82 pass over one of each six of their respective MD yarns 74, 80. The upper and lower layers 72, 78 are secured with a batt layer 84 that covers the upper layer 72. Other exemplary weave patterns for the layer(s) of the base fabric are illustrated and/or described in U.S. Pat. Nos. 4,503,113 to Smart; U.S. Pat. No. 4,565,737 to Murka, Jr. et al.; U.S. Pat. No. 4,896,702 to Crook; U.S. Pat. No. 4,976,293 to Aldrich; U.S. Pat. No. 5,110,672 to Zehle et al.; U.S. Pat. No. 5,135,802 to Gstrein et al.; and U.S. Pat. No. 5,549,967 to Gstrein et al., the disclosures of each of which are hereby incorporated herein by reference in their entireties. Other exemplary weave patterns are illustrated and described in S. Adanur, *Paper Machine Clothing* (Technomic Publishing Co., Inc. 1997).

The form of the yarns employed in the base fabrics 12, 61, 71 can vary, depending upon the desired properties of the final press felt. For example, the yarns may be multifilament yarns, monofilament yarns, twisted or cabled multifilament or monofilament yarns, spun yarns, or any combination thereof. Also, the materials from which the yarns employed in the fabric layers are formed may be those commonly used in press felts, such as polyamide, cotton, wool, polypropylene, polyester, aramid, or the like, and blends and combinations thereof. The diameters of the filaments of the yarns may vary from between about 0.02 mm to 0.6 mm (a range of 0.1 mm and 0.5 mm is preferred for CMD filaments and a range of 0.1 mm to 0.6 mm is preferred for MD filaments), and these filaments may be included either individually or in plies, which can then be used in twists or cables. The selected base fabric may vary from between about 8 to 150 machine direction yarns and 12 to 100 cross machine direction yarns per inch; the higher numbers of these ranges may include the yarns of multiple layers and laminates. The present invention can be particularly effective when used with fabrics having plied, cabled yarns having one or two plies of two or three twisted filaments, wherein the filaments have a diameter of between about 0.1 and 0.3 mm.

Referring again to FIG. 1, an upper batt layer 18 overlies the base fabric 12, and a lower batt layer 20 underlies the base fabric layer 12. These batt layers 18, 20 are attached to the base fabric 12 through the needling process as described below. The batt layers 18, 20 should be formed of material, such as a synthetic fiber like acrylic, aramid, polyester, or polyamide, or a natural fiber such as wool, that assists in wicking water away from the base fabric 12. Preferred materials for the batt layers 18, 20 include polyamide, aramid, wool, polyester and blends thereof. Fibers sized between 1.5 and 60 denier are preferred.

The weight and thickness of the batt layers 18, 20 can vary, although it is preferable that the ratio of batt weight to total press felt weight is about between about 20 and 80 percent. Also, in some embodiments, it may be desirable to have additional batt layers (such as a batt layer between the layers of a stratified fabric) or to omit either of the batt layers 18, 20. Of course, the discussion of the batt layers 18, 20 is equally applicable to the batt layers 68, 84 of the press felts 60, 70.

Figure 2:
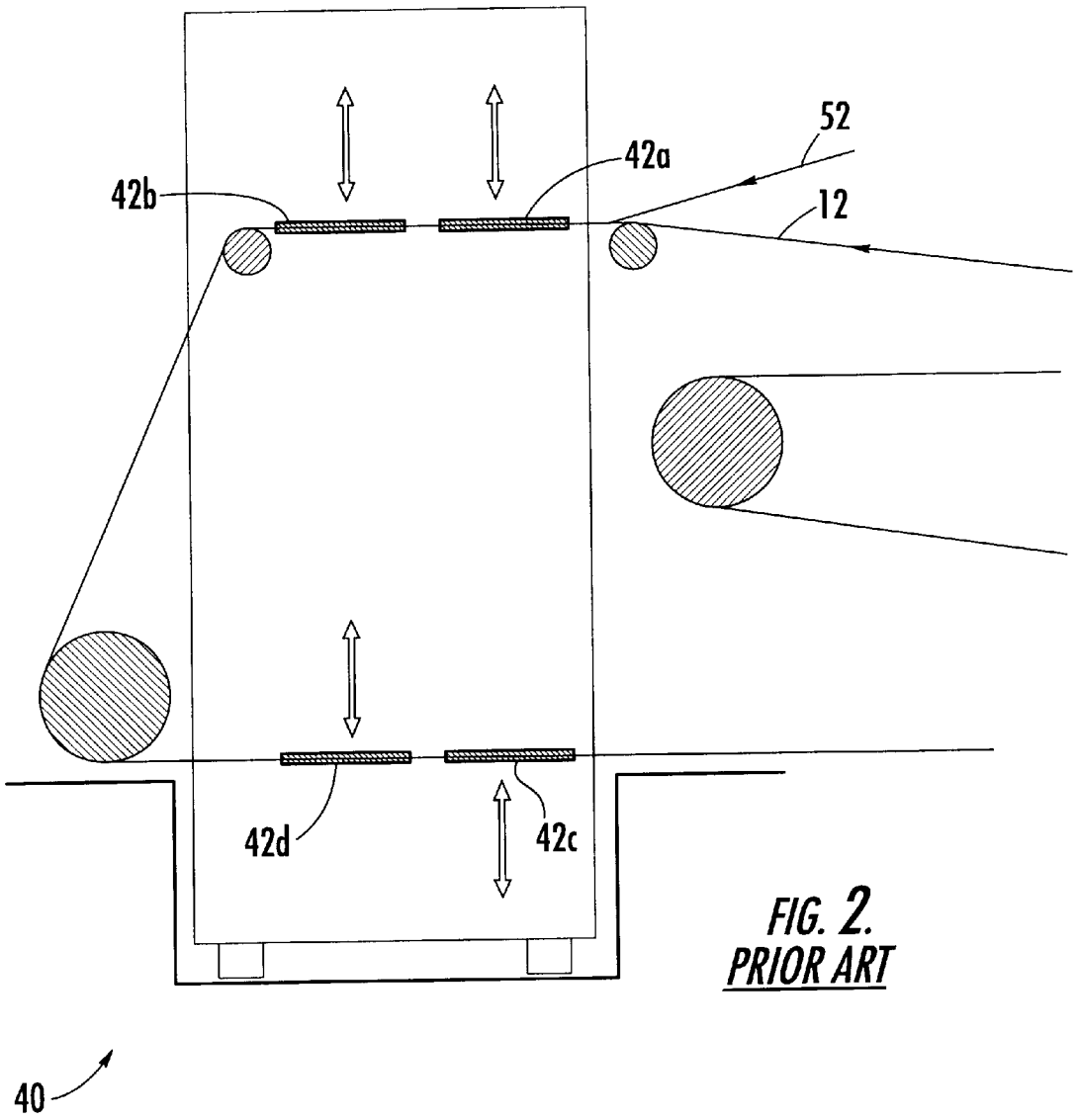
FIG. 2. PRIOR ART
FIG. 2 is a schematic diagram illustrating the general configuration of a prior art needle loom for forming a papermakers' felt.

Referring now to FIG. 2, a prior art needle loom, designated broadly at 40, is schematically illustrated therein. The needle loom 40 includes four needling zones 42*a*, 42*b*, 42*c*, 42*d*, wherein batt material from a batt web, such as the batt layers 18, 20 described hereinabove, is added to a base fabric, such as the base fabric 12 (the discussion is equally applicable to the base fabrics 61, 71 and other base fabrics suitable for use in a press felt). The needling zones 42*a*, 42*b*, 42*c*, 42*d* are essentially identical with the exceptions of their locations on the needle loom 40 and their orientation relative to the loom 40 (i.e., the needling zone 42*d* is oriented "upside down" relative to the other needling zones in order to needle the opposite side of the fabric); thus, the discussion hereinbelow directed to needling zone 42*a* is equally applicable to the other needling zones 42*b*, 42*c*, 42*d*.

Figure 3:
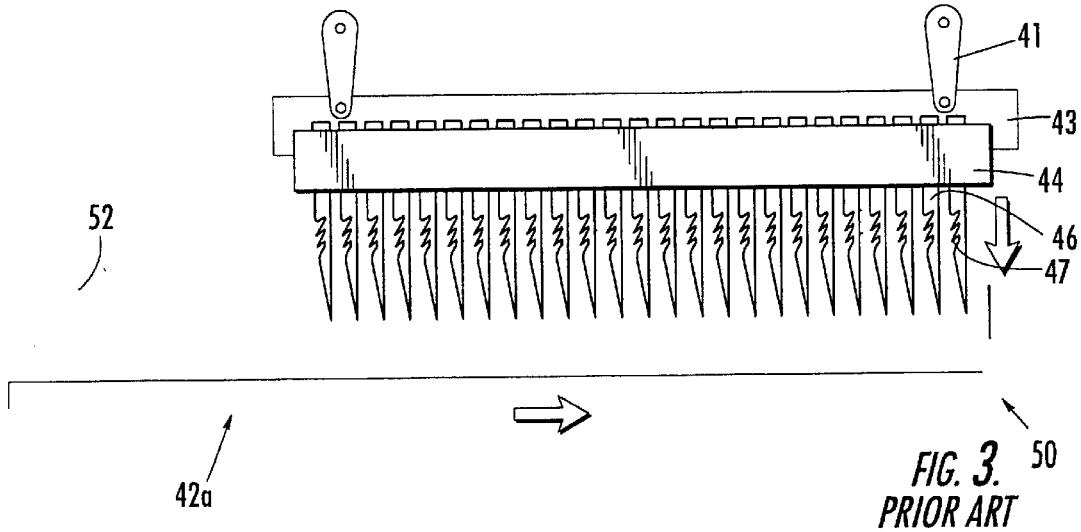
FIG. 3. PRIOR ART
FIG. 3 is an enlarged side view of a needle board with needles for the needle loom of FIG. 2.

FIG. 3 illustrates the needling zone 42*a*, which includes a needle board 44 upon which a plurality of needles 46 are mounted. The needle board 44 is substantially flat and is mounted on a needle beam 43 that is in turn mounted to the frame of the loom 40 via a reciprocating needle motion unit 41. A needle bed 50 is fixed beneath the needle board 44 and includes a plurality of apertures (not shown) that are sized and positioned to receive the needles 46. The needle motion unit 41 moves the needle beam 43 and the needle board 44 in a reciprocating vertical motion relative to the needle bed 48 such that the needles 46 are able to enter and exit the apertures in the needle bed 50.

Figure 4A:
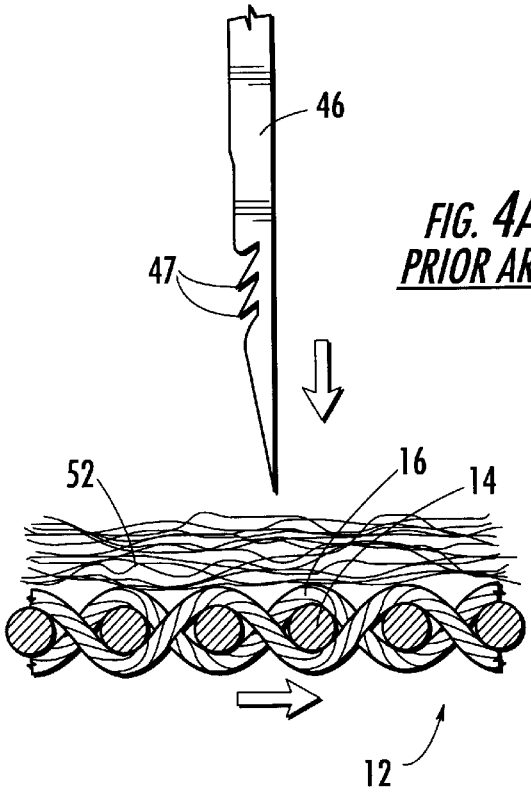
FIG. 4A. PRIOR ART
FIGS. 4A through 4C are a series of greatly enlarged side section views of a barbed needle of the needle loom of FIG. 2 as it (a) snags batt fiber from an overlying batt web (FIG. 4A), (b) inserts the batt fiber into the base fabric (FIG. 4B), and (c) retracts from the base fabric and batt web (FIG. 4C).

As best seen in FIG. 4A, each needle 46 includes one or more barbs 47 that are configured such that a downwardly-moving needle 46 tends to snag and retain batt fiber within the barb 47 as the needle passes through a batt web 52, but an upwardly-moving needle 46 tends to pass through the batt web 52 without snagging or retaining fiber. Typically, the needles 46 are between about 2.5 and 4.0 inches in length and 32 to 40 wire gauge in cross-section; most commonly, the needles 46 are triangular in cross-section, with equal sides. The barbs 47 typically have a throat length of about 0.5 to 0.8 mm and a throat depth of between about 0.06 and 0.15 mm. Most commonly, the barbs 47 are included on only one longitudinal edge of the needles 46, although other configurations may also be employed. The needles 46 are typically included in a density of between about 1,000 and 4,000 needles per lineal meter, with densities of 1,340 and 2,680 needles per lineal meter being preferred.

Figure 4B:
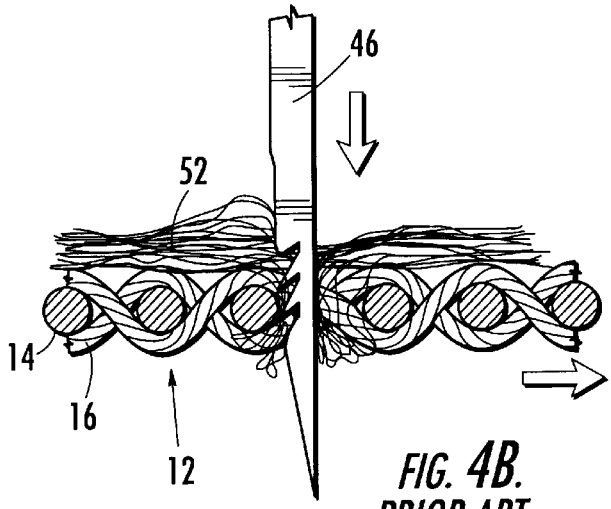
FIG. 4B. PRIOR ART
Figure 4C:
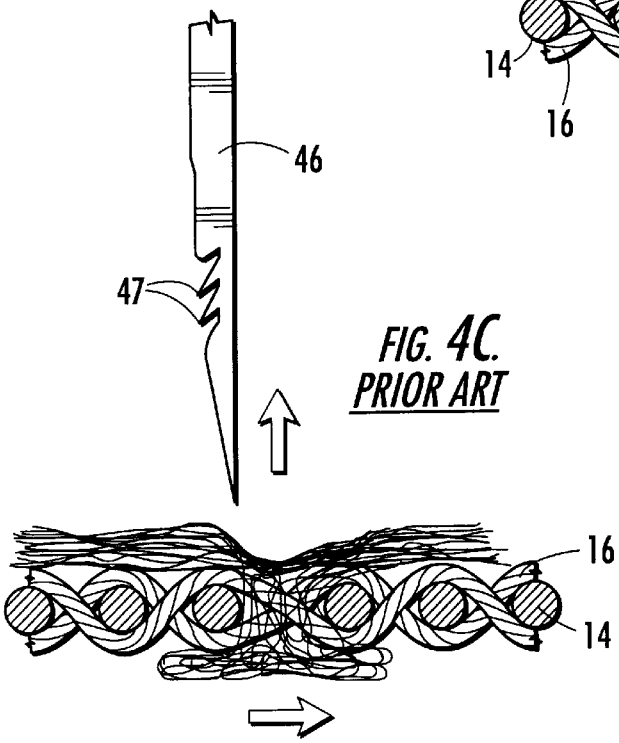
FIG. 4C. PRIOR ART

FIGS. 4A through 4C illustrate the insertion of batt fiber into the base fabric 12 within the needling zone 42*a*. As the needle 46 approaches the batt web 52 from above, the barbs 47 have no batt fiber retained therein. As the needle 46 continues moving downwardly such that its point penetrates and passes through the base fabric 12 (FIG. 4B), the needle 46 snags batt fiber of the batt web 52 and forces it into and, in some instances, below the base fabric 12. Once the batt fiber has been driven into the base fabric 12, it tends to become entangled and ensnared therein. Thus, as the needle 46 retracts from the base fabric 12 (FIG. 4C), the batt fibers tend to remain with the base fabric 12 and, eventually, form the batt layer 18; they tend not to be drawn from the base fabric 12 by the upward movement of the needle 46 because of the orientation of the barbs 47 and the absence of any "kick-up" associated with the barb 47.

Of course, the movement of the needle 46 shown in FIGS. 4A through 4C is repeated numerous times as the base fabric 12 and the batt web 52 are conveyed through the needling zone 42*a*. In the illustrated embodiment, the movement of the base fabric 12 and the batt web 52 is continuous. The base fabric 12 and batt web 52 can be needled in any or all of the needling zones 42*a*, 42*b*, 42*c*, 42*d*, any of which can have different needle configurations or stroke rates.

In many instances, the needling process is repeated multiple times; in some needling passes, the fibers from additional batt webs may be needled into the base fabric 12, and in other passes there may be no additional batt fiber applied, as the needling pass is carried out to increase the entanglement and/or reduce the thickness of the batt layer 18 already formed on the fabric.

This process may have several shortcomings when needling is carried out with a continuously moving base fabric. As shown in FIG. 4B, if the barbs 47 of the needles 46 face rearwardly, the barbs 47 can contact the CMD yarns 14 and have a "sawing" effect on them as they enter and retract from the base fabric 12, which of course can weaken the yarns for subsequent operation. As such, in many instances the needles 46 are mounted so that the barbs 47 do not face rearwardly (ie., not in the manner shown in FIG. 4) so that the sawing effect can be reduced.

Also, even in the absence of sawing by the barbs 47, the interaction of the needle 46 with the base fabric 12 and batt web 52 can cause the base fabric 12 to stretch in a localized region just forward of the needle 46 and to compress just rearward of the needle 46. This action can shift the positions of the yarns (particularly the CMD yarns 14), which can reduce the uniformity of the weave of the base fabric 12. Also, shifting of the yarns can render subsequent needlings very unpredictable, as once the yarns have shifted position, there is no technique for realigning them prior to subsequent needling passes. As a result, any attempt to needle precisely based on the assumed positions of the yarns (such as to avoid having a needle "spear" a yam rather than pass between yarns) would likely be futile.

Moreover, the interaction of the needles 46 with the base fabric 12 and batt web 52 can also have the effect of causing the batt web 52 to "thin" forwardly of the needle 46 and "bunch up" rearwardly of the needle 46. As a result, the uniformity of the surface of the batt layer 18 can be adversely impacted, particularly if this effect is magnified through multiple needling passes.

Figure 5:
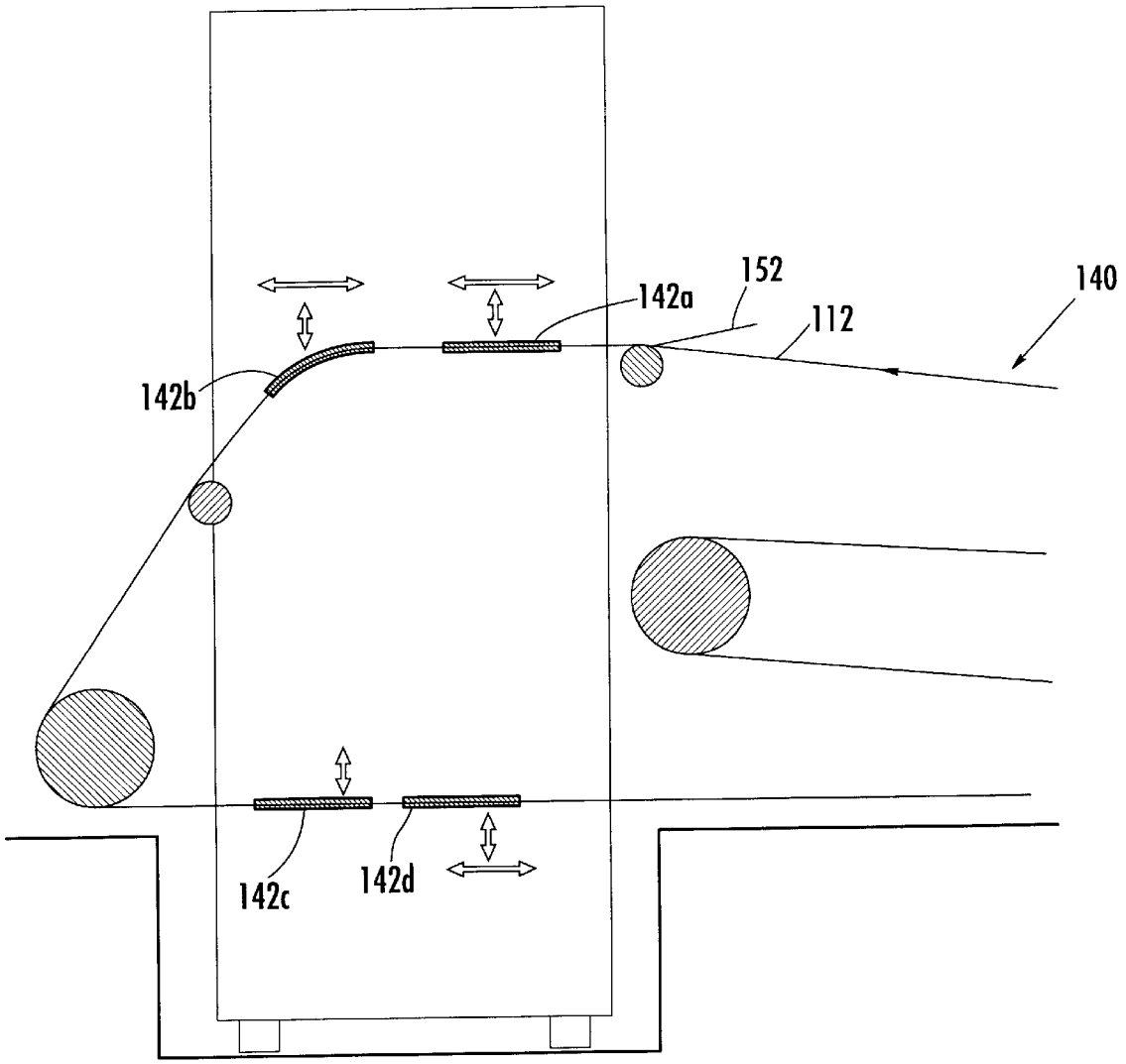
FIG. 5 is a schematic diagram illustrating a needle loom for forming a papermakers' felt with the method of the present invention.

These problems can be addressed with the method of the present invention, which can be performed with a needle loom such as that schematically illustrated in FIG. 5 and designated broadly at 140. As with the needle loom 40 of FIG. 2, the needle loom 140 includes four needling zones 142*a*, 142*b*, 142*c* and 142*d*, each of which includes a needle board 144 upon which needles 146 are mounted. Each needle board 144 is mounted on a needle beam 143 that is, in turn, mounted to the loom 140.

Figure 6:
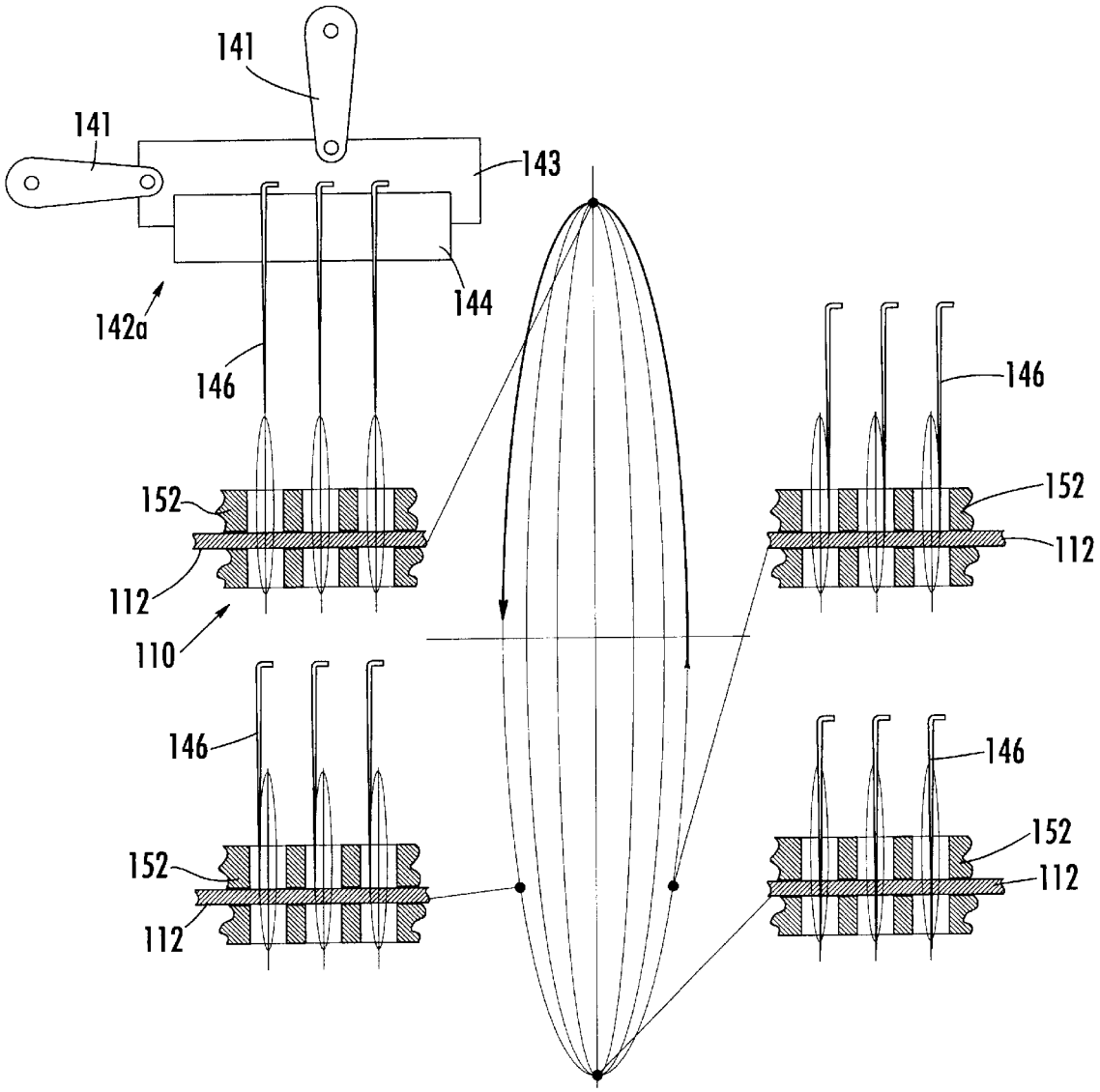
FIG. 6 is a series of greatly enlarged side views of a needle of the needle loom of FIG. 5 illustrating the cyclic oval path followed by the needle as it inserts batt fiber into the base fabric and retracts therefrom.

In contrast to the loom 40 of FIG. 2, each needle beam 143 is mounted via a needle motion unit 141 such that, rather than undergoing reciprocating motion that is strictly vertical, the needle beam 143 follows a continuous predetermined path that defines an oval (see FIG. 6). As used herein, an "oval" path is intended to be a path that is continuous and largely curvilinear; it includes elliptical and non-elliptical paths as well as continuous reciprocating curvilinear paths that are asymmetric. Generally speaking, the oval path should include both upward and downward segments, each of which has both forward and rearward motion. The path should be selected such that, as the needles 146 enter the batt web 152 and continue into the base fabric 112 to insert batt fibers, the horizontal rate of travel of the needles 146 is substantially synchronized with the substantially constant horizontal rate of travel of the base fabric 112 and the batt web 152 (typically the base fabric 112 and the batt layer 152 travel at a rate of between about 0.05 and 0.75 inches per needle stroke, with a rate of 0.085 and 0.35 inches per needle stroke being preferred). Typically, the needles 146 are inserted into the fabric at similar stroke rates as is the case for the prior art loom 40.

As an example, it may be desirable to convey a base fabric 112 and batt web 152 at a rate of 10 feet/minute. A similar horizontal speed would be desirable for the needles 146 during the insertion of the batt fiber into the base fabric 112. If the needle stroke rate is 1,000 strokes/minute, and the vertical needle stroke length is 2.4 inches (which could, for example, correspond to a needle insertion depth of 0.5 inches into the needle bed), the resulting oval path would be approximately 2.4 inches by 0.12 inches. This ratio of long axis to short axis is typical; a range of between about 15 and 30 is preferred; as is a needle stroke length of between about 1.5 and 4 inches.

Those skilled in this art will recognize that there are multiple configurations for the needle motion unit 141 that can move the needle board 144 along an elliptical path. One example is that illustrated and described in U.S. Pat. No. 5,732,453 to Dilo et al. (Dilo), the disclosure of which is hereby incorporated herein by reference in its entirety. Dilo describes a needle loom that has sets of eccentrically-mounted connecting rods that are also connected to a needle bar. At least one connecting rod is mounted vertically and induces vertical motion in the needle bar, and at least one connecting rod is mounted horizontally and induces forward and rearward motion in the needle bar. The connecting rods are coupled to produce a desired path for the needles. Other needle loom configurations that may be suitable for the present invention include other eccentrically-mounted connecting rod configurations, slider-crank mechanisms four bar-linkages and their mechanical equivalents, intermittent magnetically-driven mechanisms, hydraulically- and pneumatically-driven systems, cam follower-type systems, and the like.

The needle loom 140 can be operated on the press felt of FIG. 1 and any of the press felts described hereinabove. The loom 140 is particularly suitable for press felts having fine yarns, as the discussion that follows demonstrates It is preferred that the finished press felt be subjected to repeated needling steps such that the batt layer is needled with between about 600 and 2,000 needle penetrations per square centimeter.

The oval path followed by the needles 146 can address the shortcomings noted above for prior art needle looms. First, the ability of the needles 146 to move horizontally with the base fabric 112 can reduce the tendency of the needles 146 to stretch the MD yarns of the base fabric 112 forward of the needle 146 and to compress the MD yarns to the rear of the needle 146. As a result, the base fabric 112 can remain more uniform, which in turn can improve performance of the press felt. Also, the reduction of interaction between the needles 146 and the yarns of the base fabric 112 can enable fabrics with very fine yarns to be needled with less concern for yarn shifting or damage.

Second, a related advantage to the reduction or elimination of stretching/compressive force applied to the fabric is that the force experienced by the needle 146 is also reduced. As a result, finer needles and/or elevated needle density levels can be employed (for example, as many as 10,000 needles per lineal meter, using needles having a cross-section of 46 wire gauge). The use of higher densities and/or finer needles 146 can enable the press felt to be formed with fewer needling passes; also, the batt layer can be created with a smoother surface.

Third, the tendency of the batt web 152 to thin in front of and bunch to the rear of the inserted needles 146 is also reduced. As described above for the base fabric 112, this effect can improve the consistency of the density and surface smoothness of the batt layer, which can positively impact the performance of the press felt.

Fourth, the "sawing" effect of the barbs of the needles 146 on the CMD yarns can be significantly reduced or eliminated, as the barbs are not forced against the CMD yarns by relative horizontal movement of the base fabric 112. As such, the needles 146 may be oriented in the needle board 144 in a manner that is considered to be most desirable for the insertion of batt fibers without the fear of sawing CMD yarns. including facing rearwardly if such an orientation is desirable. In addition, needles with larger barb "kick-up" may also be employed if desirable. The reduction or elimination of "sawing" of the yarns enhances the opportunities for needling fabrics with fine yarns.

Fifth, the yarns of the base fabric 112 will tend to remain in their original positions during insertion of batt fiber rather than being displaced by the needles 146. As a result, during subsequent needling passes with the base fabric 112, the positions of those yarns should be more predictable. Accordingly, the positions of the yarns can be considered in planning the insertion of batt fiber in subsequent needling passes, such as to avoid the "spearing" of yarns described above. Again, this can be very advantageous when fabrics having very fine yarns are employed, as the spearing of a fine yam is likely to cause irreversible damage. One relatively direct method for determining the positions of the yarns is to include a marker, such as a CMD wire woven into the fabric or a visual marker imprinted on the fabric, that can be detected by a sensor associated with the loom. With the position of the marker known, the loom can then calculate or otherwise determine the positions of other yarns of the fabric, then perform the needling operation accordingly. Of course, other techniques for determining yam position, including automated scanning of the fabric, may also be used with the present invention.

Figure 7:
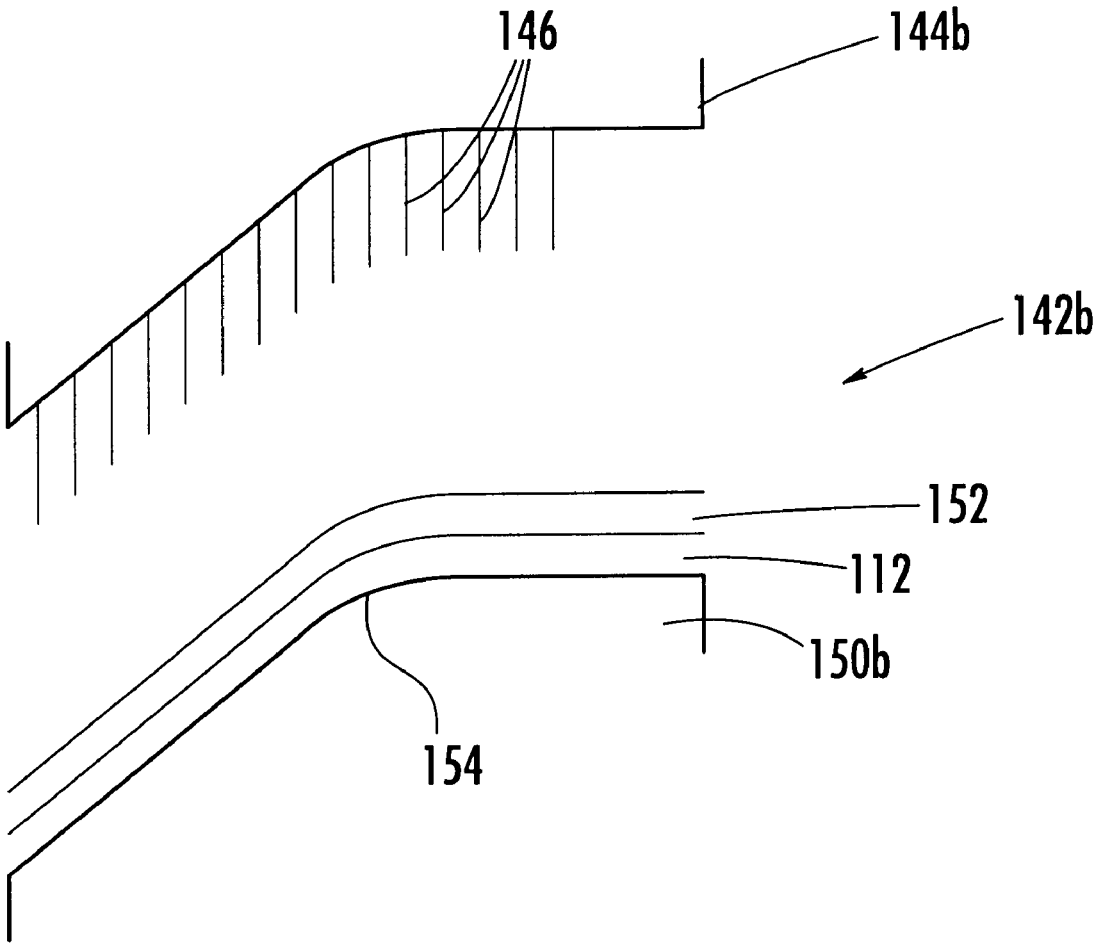
FIG. 7 is an enlarged view of a press felt with batt fibers that have been inserted at an oblique angle to the base fabric.

Unlike the needling zones 42*a*–42*d* of the needle loom 40, the needling zones 142*a*–142*d* are not identical, as needling zone 142*b* includes a biplanar needling board 144*b* and needling bed 150*b* (FIGS. 5 and 7). The profiles of the lower surface of the needle board 144*b* and the upper surface of the needle bed 150*b* substantially match one another; each slopes downwardly at an angle of approximately 15 degrees to horizontal initially, then increases to an angle of 45 degrees to horizontal after a curved transition region, although these angles can be varied and still fall within the scope of the present invention. As they travel, the base fabric 112 and batt web 152 follow the profile of the needle bed 150*b*, with the curved transition region 154 of the needle bed 152 providing a smooth transition surface for the base fabric 112 to change its travel direction. The general direction of needle insertion is vertical (like that for the needles 146 of needle zone 142*a*); i.e., the long axis of the oval of the needle path is substantially aligned with the longitudinal axis of each needle 146. Thus, the disposition of the base fabric 112 and batt web 152 at an oblique angle to the long axis of the oval path causes the needles 146 to enter the base fabric 112 and the batt web 152 at an oblique angle.

The insertion of batt fibers at an oblique angle can be particularly advantageous for improving the anchoring of batt fibers within the base fabric 112 (as much as a 40 percent increase) due to the increased length of fiber in frictional contact with the yarns of the base fabric 112 and adjacent fibers. This can improve the abrasion resistance of the press felt and decrease the risk of fiber shedding without the use of fusable fibers or other adhesion-enhancing treatments. Moreover, the oblique entry angle of the batt fiber can also reduce the compressibility of the batt layer on the finished press felt.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein. In the claims, means-plus-function clauses are intended to cover the structures described herein as performing the recited function and not only structural equivalents but also equivalent structures.

That which is claimed is:

1. A method of forming a papermakers' felt, comprising the steps of:

providing a needle loom having a needle board, a plurality of needles mounted on the needle board, and a needle motion unit that moves the needle board such that the needles mounted thereon travel on a predetermined path, wherein the predetermined path includes upward and downward segments, and wherein each of the upward and downward segments includes both forward and rearward motion;

continuously conveying a base fabric and a batt web overlying the base fabric in a first direction past the needle board, the base fabric including a first set of machine direction yarns and a first set of cross machine direction yarns interwoven with the first set of machine direction yarns in a predetermine repeating pattern, the batt web comprising batt fibers; and inserting batt fibers from the batt web into the base fabric with the plurality of needles as the base fabric is conveyed past the needle board and as the needle board travels along the predetermined path to form a batt layer attached to and overlying the base fabric.

2. The method defined in claim 1, wherein said conveying step comprises conveying the base fabric and batt layer at a rate of between about 0.05 and 0.75 inches per stroke.

3. The method defined in claim 1, wherein said conveying step is carried out at a predetermined rate, and the forward motions of the upward and downward segments of the predetermined path of the needle board are substantially synchronized with the conveying of the base fabric and batt web.

4. The method defined in claim 1, wherein the predetermined path is an oval path.

5. The method defined in claim 1, wherein the upward and downward segments of the predetermined path are between about 2.5 and 4 inches in height.

6. The method defined in claim 1, wherein the base fabric includes cross machine direction filaments having a diameter of between about 0.1 mm and 0.5 mm.

7. The method defined in claim 1, wherein the base fabric includes machine direction filaments having a diameter of between about 0.1 mm and 0.6 mm.

8. The method defined in claim 1, wherein the base fabric includes a second set of machine direction yarns.

9. The method defined in claim 8, wherein the base fabric includes a second set of cross machine direction yarns.

10. The method defined in claim 1, wherein the cross machine direction yarns are formed of polyamide, and the machine direction yarns are formed of polyamide.

11. The method defined in claim 1, wherein said conveying and inserting steps are repeated a sufficient number of times that the batt layer is processed with between about 600 and 2,000 needle penetrations per square centimeter.

12. The method defined in claim 1, wherein said inserting step is performed such that the needles enter the base fabric from one side of the base fabric and form the batt layer overlying that side of the base fabric, and wherein said conveying and inserting steps are repeated such that the needles enter the base fabric from the opposite side of the base fabric, thereby forming a second batt layer that contacts and underlies the opposite side of the base fabric.

13. The method defined in claim 1, wherein the needles include barbs on one longitudinal edge to assist in trapping fiber during the downward segment of the predetermined path, and wherein the barbs in one subset of the plurality of needles face a first horizontal direction, and the barbs of a second subset of the plurality of needles face a second horizontal direction that differs from the first horizontal direction.

14. The method defined in claim 1, wherein the plurality of needles is mounted to the needle board in a density of between about 1,000 and 10,000 needles per lineal meter.

15. A method of forming a papermakers' felt, comprising the steps of:

providing a needle loom having a needle board, a plurality of needles mounted on the needle board, and a needle motion unit that moves the needle board such that the needles mounted thereon travel on a predetermined path, wherein the predetermined path includes upward and downward segments, and wherein each of the upward and downward segments includes both forward and rearward motion;

continuously conveying a base fabric and a batt web overlying the base fabric in a first direction past the needle board, the base fabric including a first set of machine direction yarns and a first set of cross machine direction yarns interwoven with the first set of machine direction yarns in a predetermine repeating pattern, the batt web comprising batt fibers;

determining the positions of at least some of the yarns of the base fabric; and inserting a first set of batt fibers from the batt web into the base fabric with the plurality of needles as the base fabric is conveyed past the needle board and as the needle board travels along the predetermined path to form a batt layer attached to and overlying the base fabric, wherein the insertion positions of the first set of batt fibers are responsive to the positions of the yarns based on the results of said determining step.

16. The method defined in claim 15, further comprising the step of inserting a second set of batt fibers from the batt web into the base fabric as the base fabric is conveyed past a second needle board as the needle board travels along a predetermined path, wherein the insertion positions of the first set of batt fibers are responsive to the positions of the yarns based on the results of said determining step.

17. The method defined in claim 15, wherein the base fabric includes cross machine direction yarns having a diameter of between about 0.1 mm and 0.6 mm.

18. The method defined in claim 17, wherein the base fabric includes machine direction yarns having a diameter of between about 0.1 mm and 0.6 mm.

19. The method defined in claim 15, wherein the base fabric includes a second set of machine direction yarns.

20. The method defined in claim 19, wherein the base fabric includes a second set of cross machine direction yarns.

21. The method defined in claim 15, wherein the base fabric includes a marker, and wherein said determining step comprises determining the positions of the marker.

22. The method defined in claim 21, wherein the marker comprises a CMD wire.

23. A method of forming a papermakers' felt, comprising the steps of:

providing a needle loom having a needle board, a plurality of needles mounted on the needle board, and a needle motion unit that moves the needle board such that the needles mounted thereon travel on a predetermined path, wherein the predetermined path includes upward and downward segments, and wherein each of the upward and downward segments includes both forward and rearward motion;

continuously conveying a base fabric and a batt web overlying the base fabric in a first direction past the needle board, the base fabric including a first set of machine direction yarns and a first set of cross machine direction yarns interwoven with the first set of machine direction yarns in a predetermine repeating pattern, the batt web comprising batt fibers, wherein the first set of machine direction yarns comprises plied, cabled yarns having filaments with a diameter of between about 0.1 mm and 0.3 mm, and the first set of machine direction yarns comprises plied, cables yarns having filaments with a diameter of between about 0.1 mm and 0.3 mm; and inserting batt fibers from the batt web into the base fabric with the plurality of needles as the base fabric is conveyed past the needle board and as the needle board travels along the predetermined path to form a batt layer attached to and overlying the base fabric.

24. A method of forming a papermakers' felt, comprising the steps of:

providing a needle loom having a needle board, a plurality of needles mounted on the needle board, and a needle motion unit that moves the needle board such that the needles mounted thereon travel on a predetermined reciprocating path;

continuously conveying a base fabric and a batt web overlying the base fabric in a first direction over a needle bed and past the needle board, the base fabric including a first set of machine direction yarns and a first set of cross machine direction yarns interwoven with the first set of machine direction yarns in a predetermine repeating pattern, the batt web comprising batt fibers, the needle board being configured such that the fabric is presented to the needles at an oblique angle; and inserting batt fibers from the batt web into the base fabric with the plurality of needles as the base fabric is conveyed past the needle board and as the needle board travels along the predetermined path to form a batt layer attached to and overlying the base fabric.

25. The method defined in claim 24, wherein the base fabric includes cross machine direction yarns having a diameter of between about 0.1 mm and 0.6 mm.

26. The method defined in claim 25, wherein the base fabric includes machine direction yarns having a diameter of between about 0.1 mm and 0.6 mm.

27. The method defined in claim 24, wherein the base fabric includes a second set of machine direction yarns.

28. The method defined in claim 27, wherein the base fabric includes a second set of cross machine direction yarns.

29. The method defined in claim 24, wherein said inserting step is performed such that the needles enter the base fabric from one side of the base fabric and form the batt layer overlying that side of the base fabric, and wherein said conveying and inserting steps are repeated such that the needles enter the base fabric from the opposite side of the base fabric, thereby forming a second batt layer that contacts and underlies the opposite side of the base fabric.

* * * * *